US005297708A

United States Patent [19]

Carpenter

[11] Patent Number: 5,297,708

[45] Date of Patent: Mar. 29, 1994

[54] LAWN CHAIR BACKPACK

[76] Inventor: Howard A. Carpenter, 4920 Targee St., Boise, Id. 83705

[21] Appl. No.: 946,174

[22] Filed: Sep. 16, 1992

[51] Int. Cl.[5] ..... A45F 4/02

[52] U.S. Cl. ..... 224/155; 224/214; 224/262; 224/270; 297/129

[58] Field of Search ..... 224/155, 153, 209, 210, 224/211, 261, 262, 270, 214; 297/129

[56] References Cited

U.S. PATENT DOCUMENTS

| | | | |
|---|---|---|---|
| 400,757 | 4/1889 | Dixey | 224/210 |
| 3,265,260 | 8/1966 | Romney | 224/161 |
| 3,912,138 | 10/1975 | Pava | 224/155 |
| 4,720,029 | 1/1988 | Varanakis | 224/155 |

FOREIGN PATENT DOCUMENTS

| | | | |
|---|---|---|---|
| 303513 | 2/1989 | European Pat. Off. | 224/213 |

*Primary Examiner*—Linda J. Sholl

*Attorney, Agent, or Firm*—Frank J. Dykas; Craig M. Korfanta; Ken J. Pedersen

[57] ABSTRACT

A standard bent aluminum tube and nylon webbed lawn chair (1) is retrofitted with a pair of padded shoulder straps (15), a padded shoulder support (16), a fold down cargo platform (11) and a padded waist belt (19) so that when the chair is folded up into its storage position it will function as a backpack. The cargo platform (11) is pivotally attached to the bottom cross piece (2) which connects the back pair of leg uprights (4). The shoulder straps (15) are attached side by side in spaced apart relation across the upper and lower shoulder strap cross pieces (16 and 17), using detent pins or bolts (23). Upper shoulder strap cross piece (16) is fixed across the pair of aluminum tubes (5) which form the sides of the back of the folding lawn chair (1). Likewise, lower shoulder strap cross piece (17) is fixed across the pair of aluminum tubes (4) which form the back legs of the folding lawn chair (1).

13 Claims, 6 Drawing Sheets

LAWN CHAIR BACKPACK

DESCRIPTION

Background of the Invention

1. Technical Field

This invention generally relates to outdoor recreational equipment and more particularly to an apparatus for converting a folding lawn chair into a combination lawn chair and backpack.

2. Background Art

When venturing into the woods, to the beach, to the shore of a nearby lake or even to a large outdoor gathering, it is oftentimes desirable to bring a multitude of items like a lawn chair, a cooler, a picnic basket, a sleeping bag, a picnic blanket, etc. Almost everyone who has faced this prospect has wished for a convenient method to get all of their stuff into some remote spot without making several walking trips.

U.S. Pat. No. 4,487,345 to PIERCE ET AL. discloses a combination folding chair and backpack. However, the backpack is incapable of carrying large items such as coolers and the like, and it is part of a specialized chair and therefore incompatible with a standard bent aluminum tube and nylon web constructed lawn chair.

U.S. Pat. No. 4,836,938 to KOBASIC discloses a multipurpose chair structure which functions as a backpack, travois and a chair when used in conjunction with a stationary upright object, such as a tree. The structure includes a foldable platform which acts both as a seat and as a cargo platform. Unfortunately, there isn't always a tree nearby to prop the structure against in order to use it as a chair. This is the primary advantage to a free standing portable chair such as a portable foldable lawn chair. KOBASIC's structure isn't designed for use with a lawn chair, nor is it readily reconfigured to do so.

Accordingly, objects of the instant invention include providing an apparatus for converting a foldable lawn chair into a combination backpack frame and lawn chair which requires no modification to the chair itself and which can be provided in kit form and easily retrofitted to an existing lawn chair. Another object of this invention is to provide a lightweight and inexpensive device which can be utilized as both a cargo carrying device and as a lawn chair. Other objects of this invention will become apparent in the following discussion.

DISCLOSURE OF INVENTION

These objects, and others, are satisfied by a combination folding lawn chair and backpack. A standard bent aluminum tube and nylon webbed lawn chair is retrofitted with a pair of padded shoulder straps, a padded shoulder support, a fold down cargo platform and a padded waist belt so that when the chair is folded up into its storage position it will function as a backpack and when it is in its folded out position, it will function as a normal lawn chair.

The entire construction is designed to attach to the lawn chair without modifying the chair in any way. That is to say that the backpack conversion kit may be attached to the lawn chair without drilling, welding or the like. This is accomplished using both tight and loose fitting pipe clamps or brackets which encompass the tubular members of the lawn chair and hold the backpack conversion structure.

A fold-down cargo platform is attached to the tubular cross member which joins the lower extremities of the two back legs of the lawn chair. The platform is attached to the cross piece using loose fitting pipe clamps or brackets such that the platform pivots or hinges about the cross piece. The platform is here made from aluminum tubing which is very similar to that used in manufacturing the foldable lawn chair, however, many different constructions and configurations are possible.

A pair of cables or chains are used to keep the cargo platform from rotating down past a generally horizontal position. Each cable is attached to the rear edge of the cargo platform and to a point on one of the back legs of the folding lawn chair. This provides a means for stopping and holding the platform in a horizontal position.

An upper shoulder strap cross piece is fixed across the pair of aluminum tubes which form the sides of the back of the folding lawn chair. The upper shoulder strap cross piece serves both as a back support member which helps to distribute the weight of the backpack and as an attachment place for the upper ends of the pair of shoulder straps. Additionally, the upper shoulder strap cross piece is padded to add comfort and make the load easier to bear.

Likewise, a lower shoulder strap cross piece is fixed across the pair of aluminum tubes which form the back legs of the folding lawn chair. The lower shoulder strap cross piece serves as both an attachment for the lower ends of the pair for shoulder straps and as an attachment support for the waist belt. The waist belt is of adjustable length and also padded to increase the comfort level of the user.

The shoulder straps are also of adjustable length. They are attached side by side in spaced apart relation across the upper and lower shoulder strap cross pieces.

To use the device as a backpack, the lawn chair is folded up into its storage position and the cargo platform is folded down into its horizontal position. The cargo platform is then loaded with the cargo which is desired to be carried. The cargo is then secured to the platform using elastic cords or the like. The user then dons the lawn chair backpack just as she would any other backpack. To use the device as a lawn chair, the device is first removed from the back of the user, the cargo platform is unloaded and the lawn chair is unfolded into its normal sitting position. The cargo platform can be either folded up or left down and used to provide a level storage surface for items placed under the lawn chair such as a fishing tackle box or the like.

BEST MODE FOR CARRYING OUT INVENTION

Figure 1:
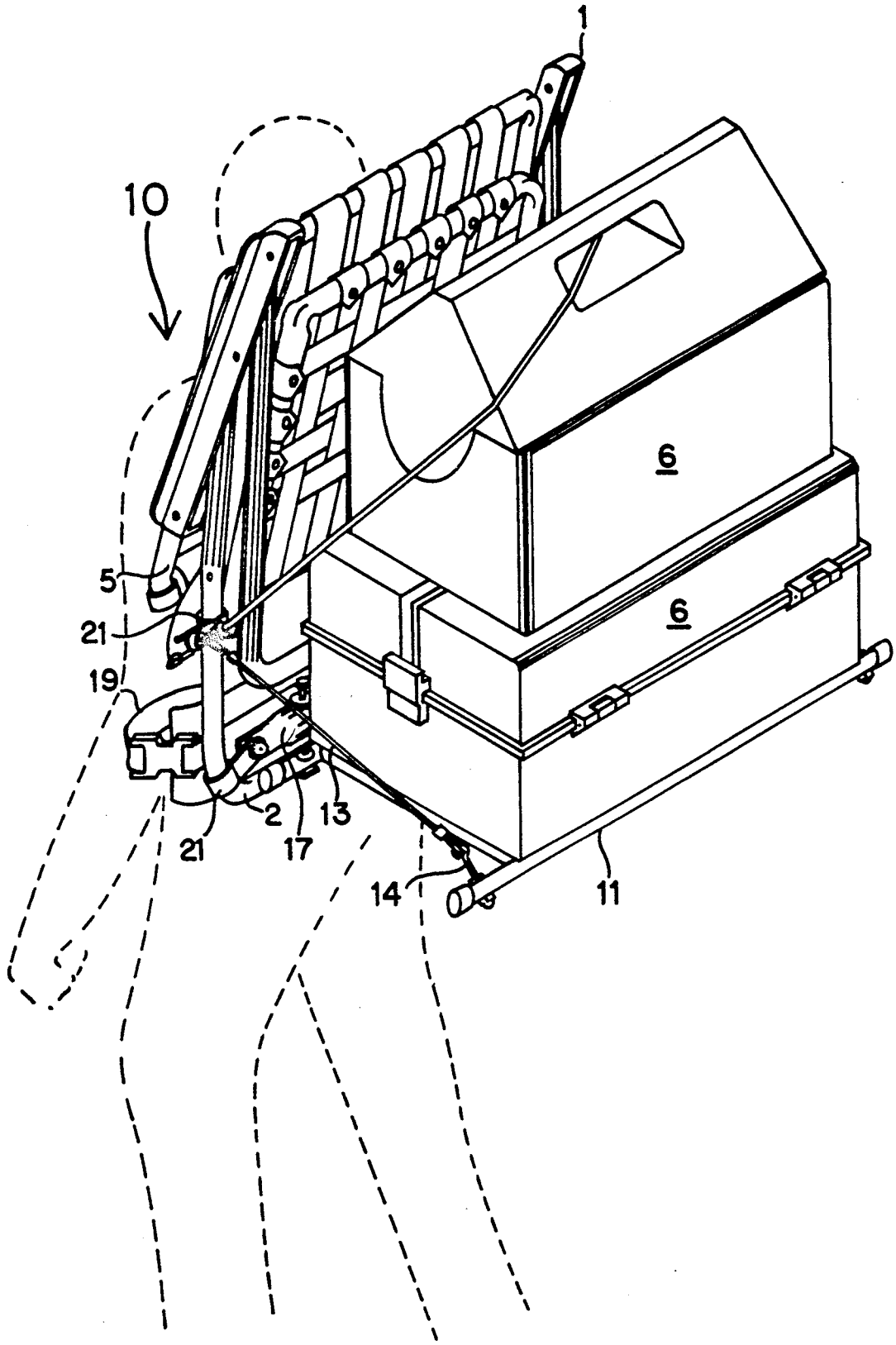
FIG. 1 is a three-quarter perspective view of the lawn chair backpack in use as a backpack.
Figure 2:
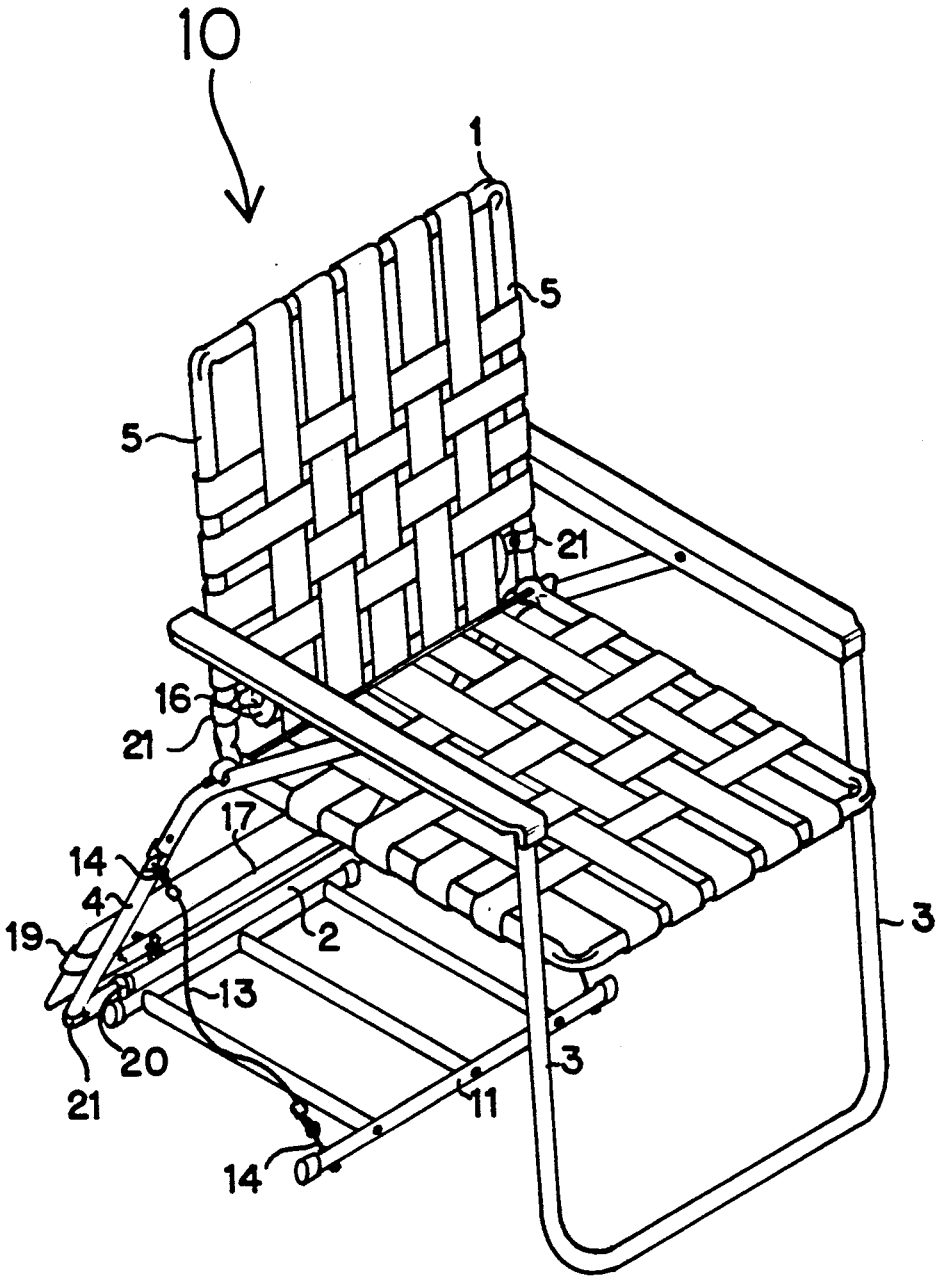
FIG. 2 is a three-quarter perspective view of the lawn chair backpack in use as a lawn chair.
Figure 3:
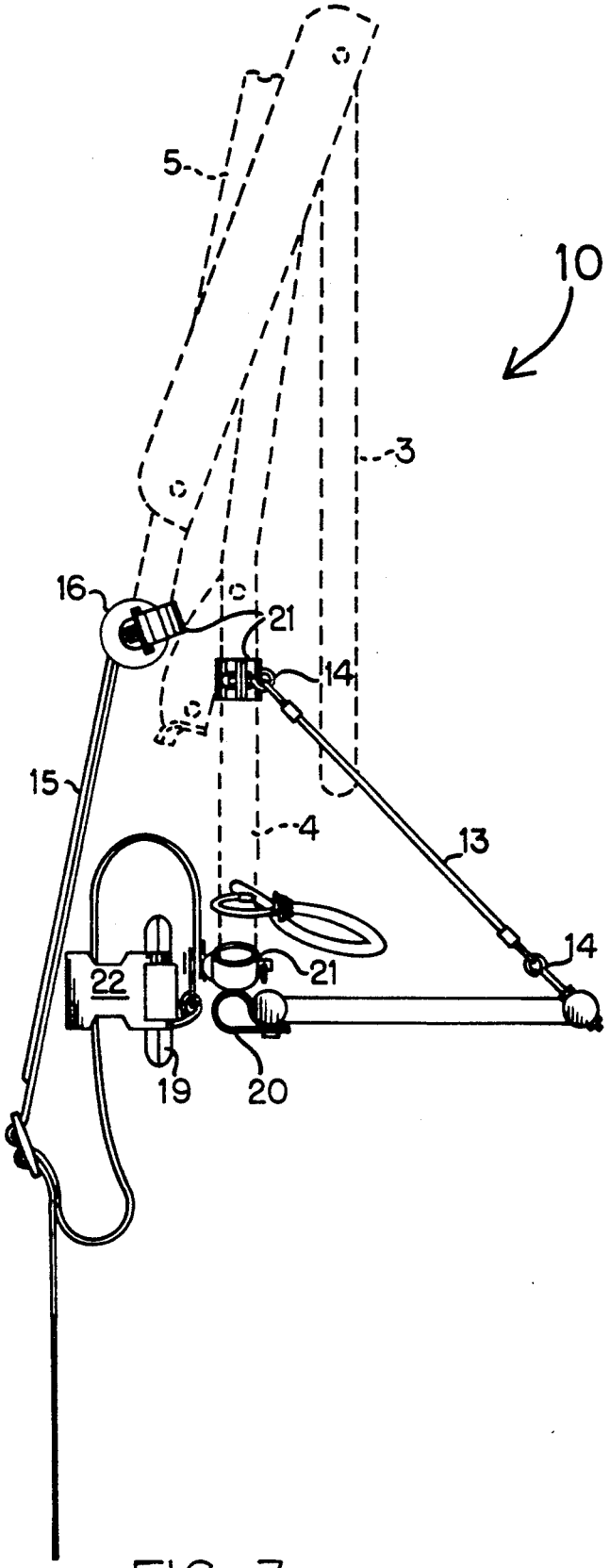
FIG. 3 is a side view of the lawn chair backpack showing the lawn chair in a folded up position and in dotted lines.
Figure 4:
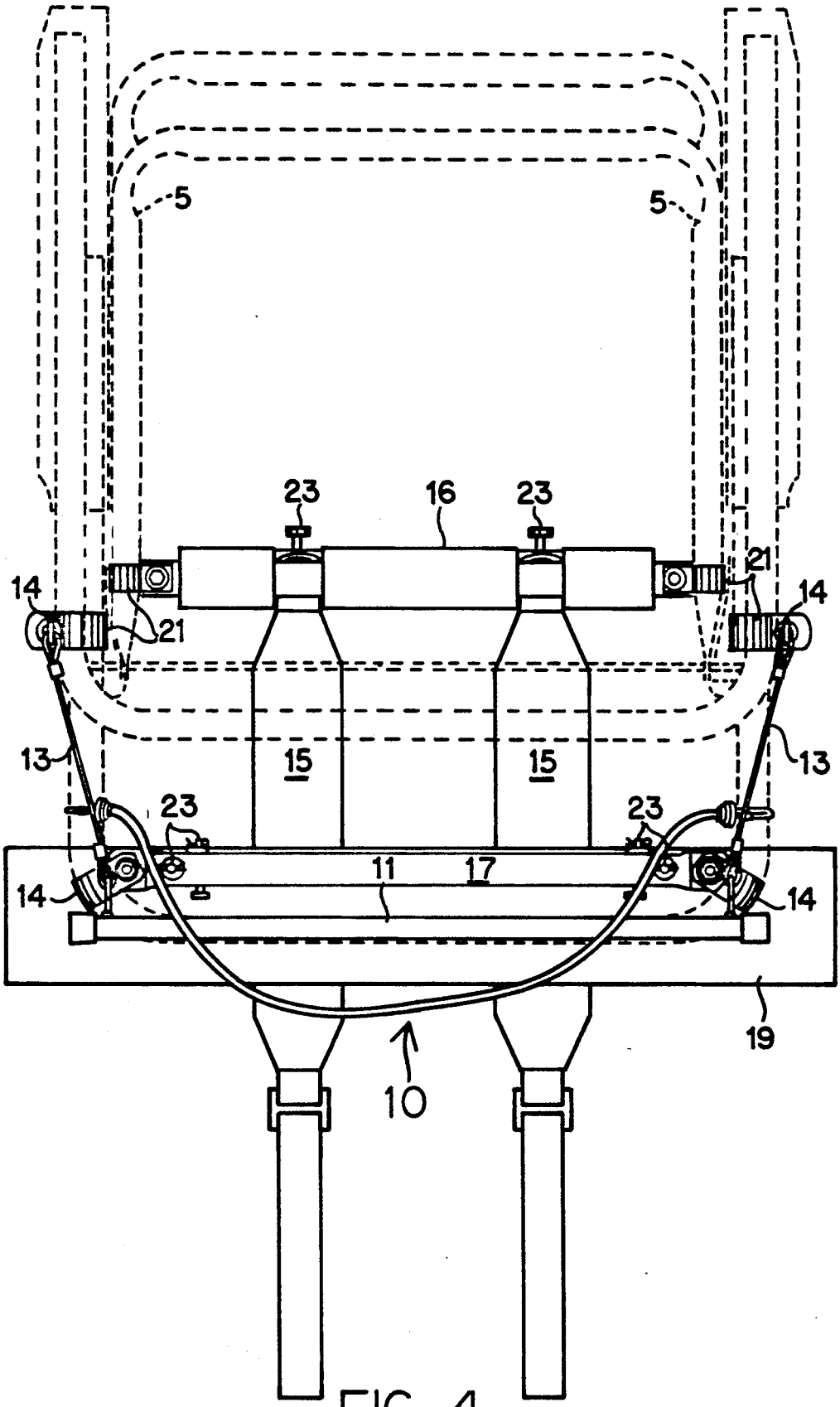
FIG. 4 is a front view of the lawn chair backpack showing the lawn chair in a folded up position and in dotted lines.
Figure 5:
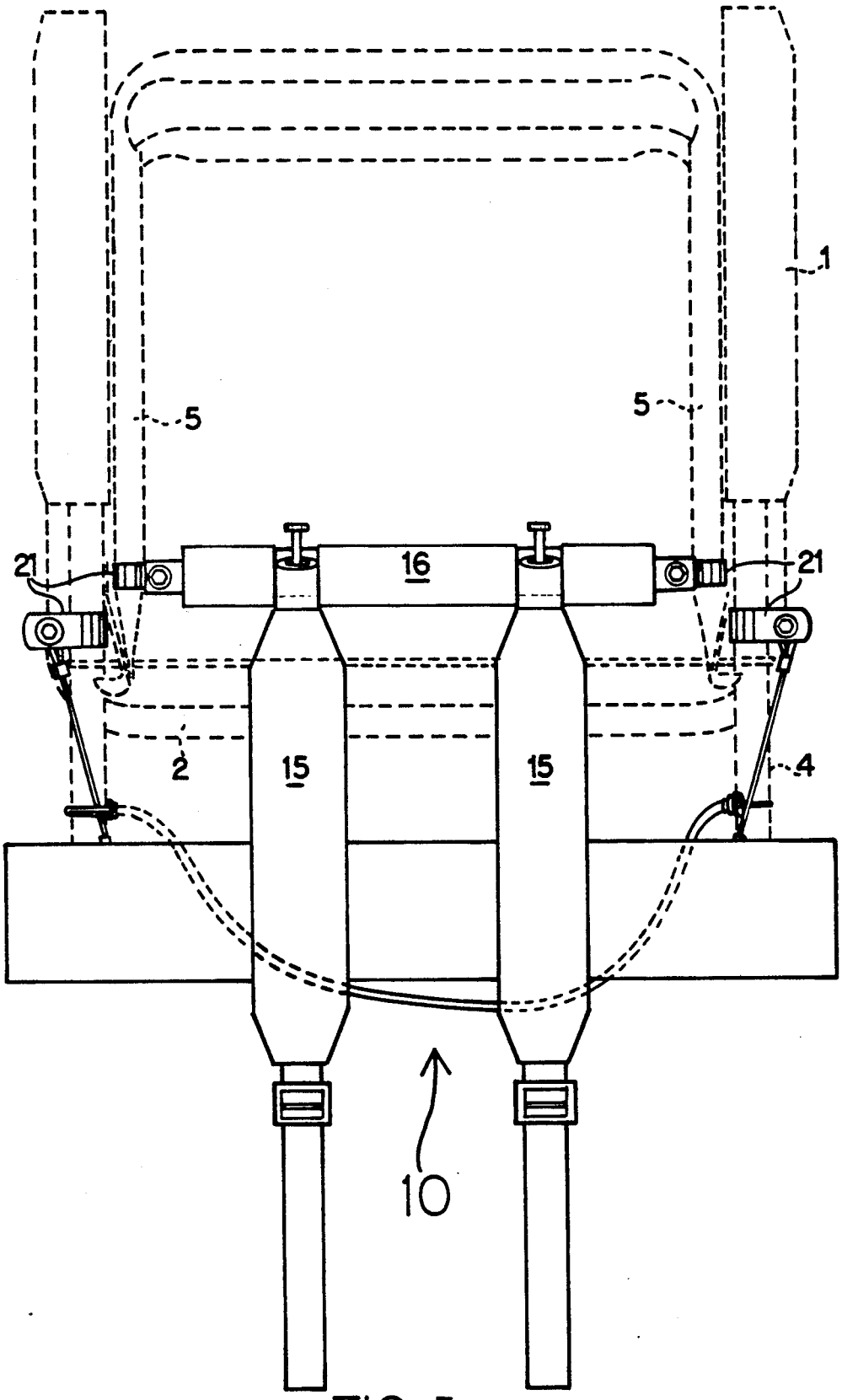
FIG. 5 is a back view of the lawn chair backpack showing the lawn chair in a folded up position and in dotted lines.
Figure 6:
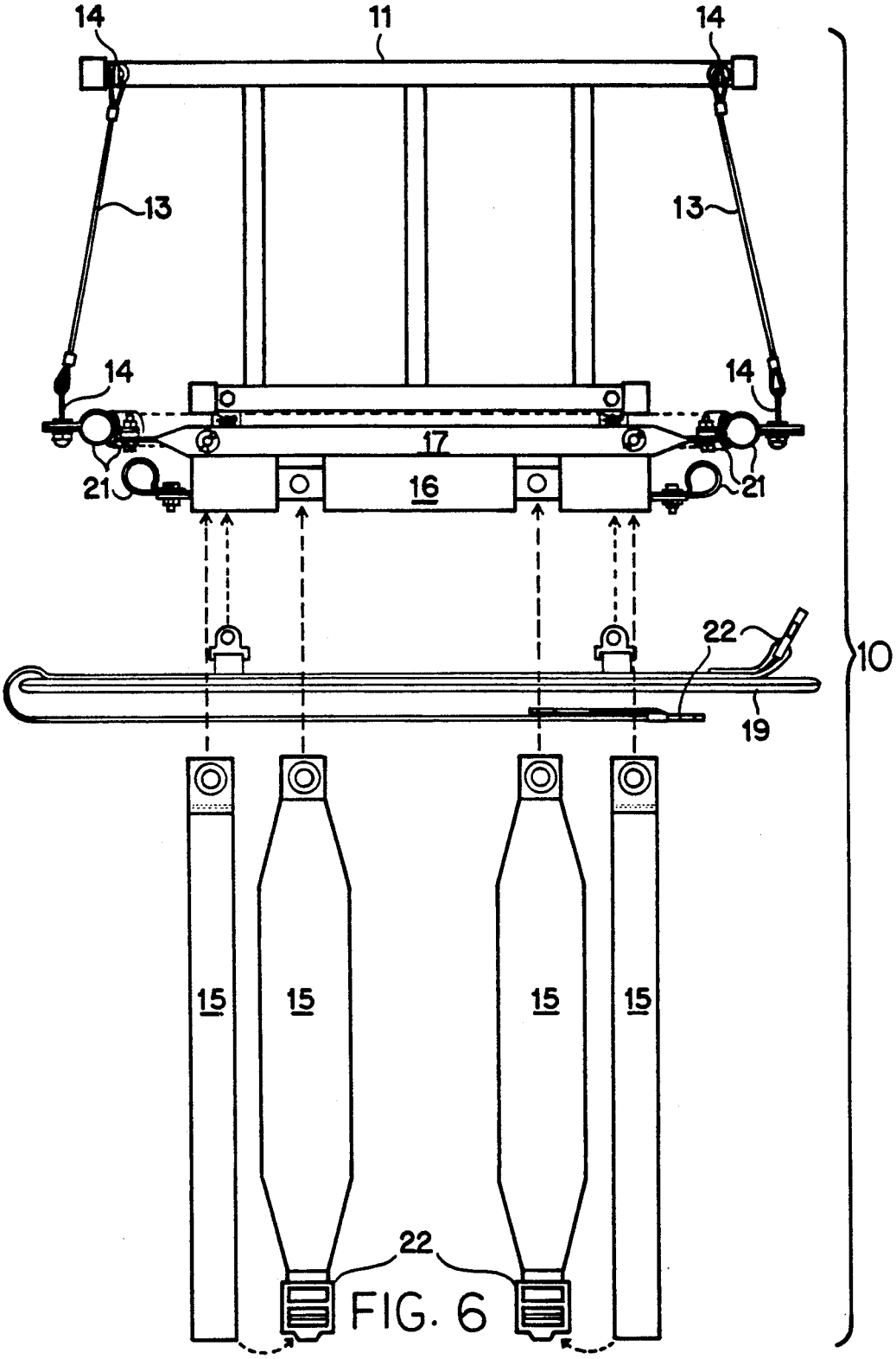
FIG. 6 is a partially exploded, top view of the lawn chair backpack.

The lawn chair backpack is generally designated as 10 in the attached drawings and continued reference to the drawings will be made in the following detailed disclosure. Lawn chair backpack 10 generally consists of a standard folding lawn chair 1 to which a cargo platform 11 and a pair of shoulder straps 15 are attached. Optional or additional features include an adjustable length belt 19, padding on shoulder straps 15, shoulder straps adjustment means 22 and padded back support, which is here also the upper shoulder strap cross piece 16.

Folding lawn chair 1 is here of common aluminum bent tube and nylon web construction which includes a pair of front leg upright members 3 held in parallel spaced relation by a bottom cross piece 2 and a pair of back leg upright members 4 which are likewise held in parallel spaced relation by a second bottom cross piece 2'. Both the seat and back rest of the chair are constructed from similar "U" shaped tube sections with the legs of the "U" forming the sides of the seat and back rest, the parallel seat side members being designated as 5, and the back side members being designated as 5'.

Cargo platform 11 is here constructed of aluminum tubing which can be joined using any suitable method. The inventor has successfully used bolts or screws in connection with well plugs, to accomplish the joints, and tube caps to finish the ends of the tubes. A well plug is a conventional fastening device for "T" connections in tubular metal parts assembly. It consists of a rubber-like plug with a central opening inserted in the end of the tube which is to be the base of the "T". The plug has a threaded nut on its innermost end. The tube which is to be the top of the "T" has a hole drilled transversely through it, and a long, threaded bolt inserted through the hole. When the tubes are joined to form the "T", the threaded bolt passes through the central opening of the well plug, and engages cooperatively with the nut on the plug's innermost end. When the bolt is tightened, it compresses the plug and forces the plug into a tight friction fit with the inside surface of the tube which is the base of the "T". It should be noted that the platform can be formed or constructed in many configurations and from many different materials. For instance, it could be made from rolled or stamped aluminum grate material or manufactured from plastic or even from wood.

The cargo platform 11 is pivotally attached to the bottom cross piece 2' which connects the back pair of leg uprights 4. Cargo platform 11 is attached using a pair of loose fitting pipe clamps or brackets 20. Loose fitting clamps 20 provide a pivot or hinge feature which allows cargo platform 11 to fold up and out of the way, or to fold down into a cargo carrying position where platform 11 is roughly perpendicular to the leg uprights 4.

A pair of support cables 13 are each attached between one of the leg uprights 4 and the back outside edge of cargo platform 11 to provide a means for stopping and holding the platform in perpendicular relation to the leg uprights 4. Support cables 13 are each attached to cargo platform 11 using an eye bolt 14. Additionally, cables are each attached to one the leg uprights 4 using tight fitting pipe clamps or brackets 21. The length of cables 13 is such that the platform 11 isn't allowed to rotate beyond the horizontal or perpendicular position.

An upper shoulder strap cross piece 16 is fixed across the pair of aluminum tubes which form the sides of the back of the folding lawn chair, each here designated as 5'. The upper strap cross piece is attached using tight fitting pipe clamps 21 to provide both a rigid back support member to distribute the weight of the backpack and as an attachment place for the upper ends of the pair of shoulder straps 15. Additionally, the upper shoulder strap cross piece 16 is padded to add comfort and make the load easier to bear for the user.

Likewise, a lower shoulder strap cross piece 17 is fixed across the pair of aluminum tubes which form the back legs of the folding lawn chair, here designated as 4. Again, tight fitting pipe clamps 21 are used to provide a rigid support member to serve as both an attachment place for the lower ends of the pair for shoulder straps 15 and as an attachment support for the waist belt 19. The waist belt 19 is of adjustable length and also padded to increase the comfort level of the user. Here, waist belt 19 is made from a nylon strap material and an adjustable position buckle or clasp 22 and includes a pad, which is here a nylon fabric encapsulated pillow.

The shoulder straps 15 are attached side by side in spaced apart relation across the upper and lower shoulder strap cross pieces 16 and 17, using detent pins or bolts 23. Each shoulder strap 15 is similar in construction to waist belt 19 and is also adjustable in length to enable the user to custom fit the pack to his or herself.

To use the lawn chair backpack 10 as a backpack, the lawn chair 1 is folded up into its storage position and the cargo platform 11 is folded down into its horizontal position. The cargo platform 11 is then loaded with whatever cargo 6 desired to be carried. The cargo 6 is secured to the platform 11 using elastic cords or the like. The user then dons the lawn chair backpack 10 just as she would any other backpack. To use the lawn chair backpack as a lawn chair 1, the device is first removed from the back of the user, the cargo platform 11 is unloaded and the lawn chair is unfolded into its normal sitting position. The cargo platform 11 can be either folded up or left down and used to provide a level storage surface for items placed under the lawn chair such as a fishing tackle box or the like.

It should be noted that different constructions of folding lawn chairs necessitate small variations in the design, such as the attachment configuration of the upper shoulder cross piece 16, for instance in the case where a single pair of uprights form both the lower back legs of the lawn chair and the sides of the back rest. In this instance, the both the upper shoulder strap cross piece 16 and the lower shoulder strap cross piece 17 would be attached to the same pair of uprights. Additionally, while reference has been made continuously throughout this disclosure to a folding lawn chair, it isn't necessary that the folding chair be a lawn chair per se.

Other like changes are considered within the scope of this invention. This disclosure is not intended to limit the invention to a particular configuration of folding chair.

While there is shown and described the present preferred embodiment of the invention, it is to be distinctly understood that this invention is not limited thereto but may be variously embodied to practice within the scope of the following claims.

I claim:

1. A chair/backpack comprising:

a folding chair including a pair of upright members held in parallel spaced relation by a bottom cross-piece;

a cargo platform being rotatably attached about the bottom cross piece and being rotatable between a folded up position where the platform is roughly parallel to the upright members and a folded down position where the platform is roughly perpendicular to the upright members;

a pair of shoulder straps; and attachment means for attaching the shoulder straps to the folding chair and holding the straps in parallel spaced apart relation.

2. The chair/backpack of claim 1 wherein the attachment means comprises:

an upper shoulder strap cross piece being fixed across the upright members;

a lower shoulder strap cross piece being fixed across the upright members in spaced apart relation to the upper cross piece; and the shoulder straps being attached at upper ends to the upper cross piece and at lower ends to the lower cross

3. The chair backpack of claim 2 further comprising perpendicular stop and holding means for stopping and holding the cargo platform in perpendicular relation to the upright members when the platform is in its folded down position.

4. The chair/backpack of claim 3 wherein the stop and holding means comprises a cable being attached between one of the upright members and a point on the cargo platform toward a back outside edge of the platform.

5. The chair/backpack of claim 4 further comprising an adjustable length waist belt being attached to the lower shoulder strap member for securing the chair/-backpack around the waist of a user.

6. The chair/backpack of claim 5 wherein the upper shoulder strap cross piece is padded to help to more evenly distribute any load to a user.

7. The chair/backpack of claim 4 wherein the upper shoulder strap cross piece is padded to help to more evenly distribute any load to a user.

8. The chair/backpack of claim 3 wherein the upper shoulder strap cross piece is padded to help to more evenly distribute any load to a user.

9. The chair/backpack of claim 2 wherein the upper shoulder strap cross piece is padded to help to more evenly distribute any load to a user.

10. The chair/backpack of claim 3 further comprising an adjustable length waist belt being attached to the lower shoulder strap member for securing the chair/-backpack around the waist of a user.

11. The chair/backpack of claim 2 further comprising an adjustable length waist belt being attached to the lower shoulder strap member for securing the chair/-backpack around the waist of a user.

12. The chair backpack of claim 1 further comprising perpendicular stop and holding means for stopping and holding the cargo platform in perpendicular relation to the upright members when the platform is its folded down

13. The chair/backpack of claim 12 wherein the stop and holding means comprises a cable being attached between one of the upright members and a point of the cargo platform toward a back outside edge of the platform.

* * * * *